US011015345B1

(12) United States Patent
Smith

(10) Patent No.: US 11,015,345 B1
(45) Date of Patent: May 25, 2021

(54) CONCRETE WALL SECTION

(71) Applicant: Walter Smith, Corbin, KY (US)

(72) Inventor: Walter Smith, Corbin, KY (US)

( * ) Notice: Subject to any disclaimer, the term of this patent is extended or adjusted under 35 U.S.C. 154(b) by 0 days.

(21) Appl. No.: 16/746,817

(22) Filed: Jan. 18, 2020

(51) Int. Cl.
*E04C 1/41* (2006.01)
*E04B 2/04* (2006.01)
*E04B 2/02* (2006.01)

(52) U.S. Cl.
CPC ..... *E04C 1/41* (2013.01); *E04B 2/04* (2013.01); *E04B 2002/0202* (2013.01)

(58) Field of Classification Search
CPC ..... E04C 1/41; E04B 2/04; E04B 2002/0202
See application file for complete search history.

(56) References Cited

U.S. PATENT DOCUMENTS 1,971,994 A * 8/1934 Smith ..... E04B 2/708 52/316
2,045,482 A * 6/1936 Maier ..... E04B 2/842 52/316
4,147,000 A * 4/1979 Lewandowski ..... E04B 2/702 52/233
4,229,497 A * 10/1980 Piazza ..... B28B 19/003 264/256
4,288,954 A * 9/1981 O'Donnell ..... E04B 1/167 52/233
4,433,520 A * 2/1984 Maschhoff ..... E04B 2/32 52/275
4,574,550 A * 3/1986 Maschhoff ..... E04B 2/40 52/309.12
5,519,973 A 5/1996 Keith et al.
5,657,594 A * 8/1997 Morita ..... E04B 1/80 52/249
5,685,116 A * 11/1997 Bradshaw ..... B44C 5/0461 52/255
6,119,606 A 9/2000 Clark
6,187,409 B1 * 2/2001 Mathieu ..... B28B 19/0092 428/70
6,202,375 B1 * 3/2001 Kleinschmidt ..... E04C 2/044 52/281
6,205,726 B1 * 3/2001 Hoadley ..... E04B 2/16 52/309.12
6,266,934 B1 * 7/2001 Houseal ..... E04B 2/702 52/233
6,282,853 B1 * 9/2001 Blaney ..... E04C 2/044 52/223.7
6,851,233 B2 * 2/2005 Morgenstern ..... E04B 1/20 52/233
6,898,908 B2 * 5/2005 Messenger ..... E04C 2/044 52/268
7,444,786 B2 11/2008 Morgenstern
7,913,469 B2 3/2011 Qu et al.
7,984,594 B1 * 7/2011 Propst ..... B32B 3/18 52/309.12
8,074,413 B2 * 12/2011 Stein ..... E04B 1/24 52/233
8,151,539 B2 * 4/2012 Grinsted ..... E04C 2/205 52/745.1

(Continued)

*Primary Examiner* — Rodney Mintz
(74) *Attorney, Agent, or Firm* — Business Patent Law, PLLC

(57) ABSTRACT

A concrete wall section manufactured with a weight that allows the user of the concrete wall section to transport manually the concrete wall section. Combinations of concrete wall sections can be used to replace traditional frames of a structure.

5 Claims, 9 Drawing Sheets

(56) References Cited

U.S. PATENT DOCUMENTS 8,302,355 B2 * 11/2012 Cook ..... E04F 13/0898 52/233
8,387,338 B1 3/2013 Smith
8,499,514 B2 * 8/2013 Farrell, Jr. ..... E04C 2/044 52/371
8,567,139 B2 * 10/2013 Stein ..... E04B 1/24 52/233
8,701,364 B2 * 4/2014 Wrightman ..... E04B 2/702 52/233
8,877,329 B2 * 11/2014 Ciuperca ..... B32B 13/12 428/215
9,157,233 B2 10/2015 Gosain
9,677,270 B2 * 6/2017 Serino ..... B32B 37/14
10,309,105 B2 6/2019 Foderberg
10,815,660 B2 * 10/2020 Tremblay ..... E04C 2/296
10,941,571 B2 * 3/2021 Wasniewski ..... E04B 1/88
2003/0054189 A1 * 3/2003 Morgenstern ..... E04B 1/20 428/540
2004/0187411 A1 9/2004 Clegg
2005/0000176 A1 * 1/2005 Morgenstern ..... E04B 1/20 52/233
2005/0115177 A1 * 6/2005 Morgenstern ..... E04B 1/20 52/233
2011/0067331 A1 * 3/2011 Grinsted ..... E04C 2/205 52/309.4
2011/0173911 A1 * 7/2011 Propst ..... B32B 5/26 52/309.13
2012/0058299 A1 3/2012 Serwin
2014/0087158 A1 * 3/2014 Ciuperca ..... B32B 7/02 428/215
2014/0123583 A1 * 5/2014 Arriola Serrano ..... E04B 2/16 52/405.1
2014/0215949 A1 * 8/2014 Cossette ..... E04C 1/41 52/568
2017/0191266 A1 * 7/2017 Androsiuk ..... E04C 1/41
2020/0048903 A1 * 2/2020 Wasniewski ..... E04B 1/66
2020/0308829 A1 * 10/2020 Hunsaker ..... E04B 1/944
2020/0392731 A1 * 12/2020 Sloane ..... E04C 2/46

* cited by examiner

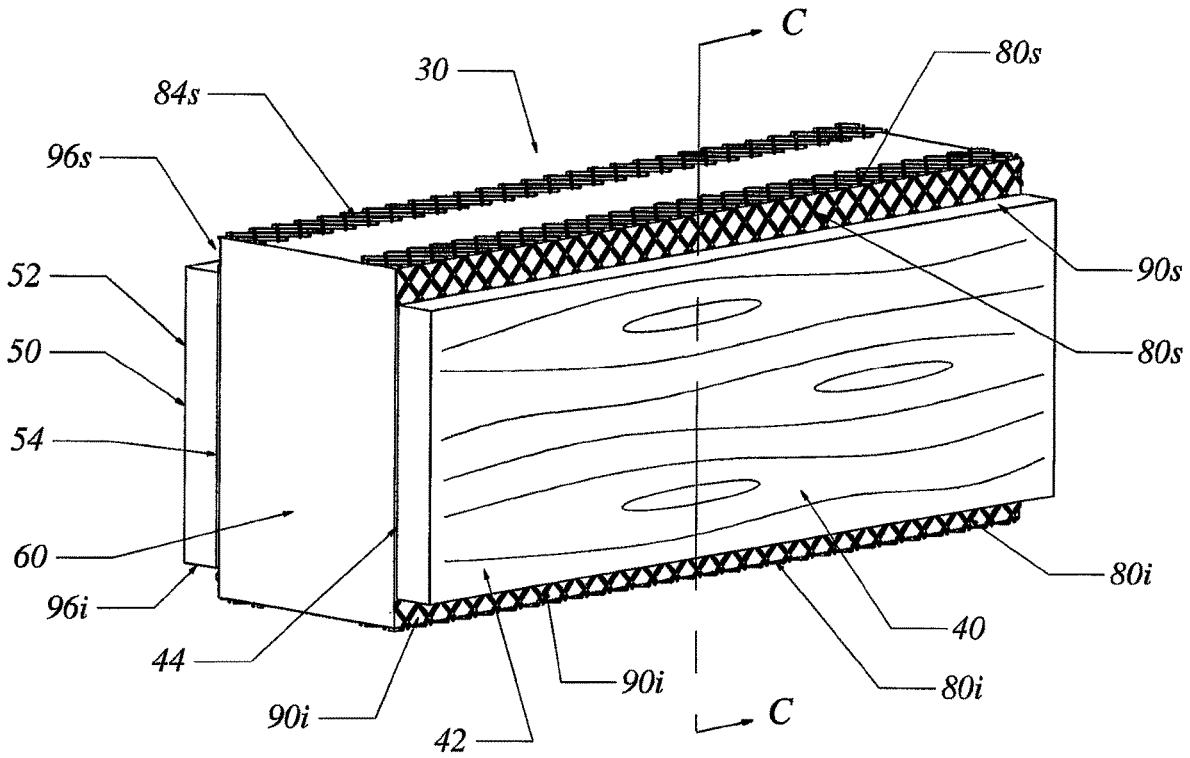
Fig 1
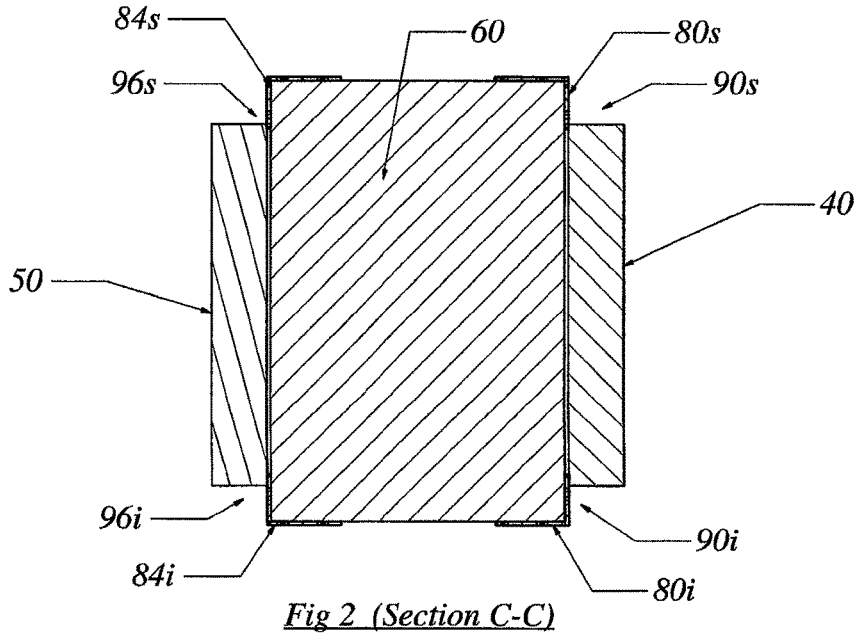
Fig 2 (Section C-C)

FIG 9

240
Providing reusable molds for making concrete wall sections (30) for a structure, wherein the concrete wall sections (30) are of such dimension and weight each concrete wall section (30) is manually moveable without the assistance of lifts or other transportation devices

↓

242
Pouring concrete into a first mold for making an outward concrete slab (40) of the concrete wall section (30); the concrete wall section (30) comprising an outer face (42) and an opposed surface (44), wherein the pourable concrete comprises from about 20% to about 30 water, from about 0 % to about 20% aggregate, from about 30 % to about 40% sand and Portland cement with or without additional constituents Pouring concrete into a second mold for making an inward concrete slab (50) of the concrete wall section (30; the concrete wall section (30) comprising an inward face (52) and an outward surface (54), wherein the pourable concrete comprises from about 20% to about 30 water, from about 0 % to about 20% aggregate, from about 30 % to about 40% sand and Portland cement with or without additional constituents Pouring concrete into a third mold connected to a lateral side of the concrete wall section (30); the third mold making interconnection members (120f, 120s) for one or more concrete wall sections (30), wherein the pourable concrete comprises from about 20% to about 30 water, from about 0 % to about 20% aggregate, from about 30 % to about 40% sand and Portland cement with or without additional constituents

↓

244
Positioning an insulator-connector (60) between the outward surface (54) and the opposed surface (44) and extending the insulator-connector (60) in superior and inferior distances beyond the vertical lengths of the outward surface (54) and the opposed surface (44)

↓

246
Connecting distinct meshes (80s, 80i, 84s, 84i) to a portion of the insulator-connector (60) extending beyond the outward surface (54) and the opposed surface (44)

↓

248
Creating a bond between the insulator-connector (60) and the outward surface (54) and the opposed surface (44), thereby stabilizing the concrete wall section (30) for transport

↓

250
Subsequent to curing, interlocking a cured first interconnection member (120f) with a cured second interconnection member (120s) to create a corner for an interlocked first concrete wall section (30) and a second concrete wall section (30)

FIG 10

240
Providing reusable molds for making concrete wall sections (30) for a structure, wherein the concrete wall sections (30) are of such dimension and weight each concrete wall section (30) is manually moveable without the assistance of lifts or other transportation devices

↓

242
Pouring concrete into a first mold for making an outward concrete slab (40) of the concrete wall section (30); the concrete wall section (30) comprising an outer face (42) and an opposed surface (44), wherein the pourable concrete comprises from about 20% to about 30 water, from about 0 % to about 20% aggregate, from about 30 % to about 40% sand and Portland cement with or without additional constituents Pouring concrete into a second mold for making an inward concrete slab (50) of the concrete wall section (30; the concrete wall section (30) comprising an inward face (52) and an outward surface (54), wherein the pourable concrete comprises from about 20% to about 30 water, from about 0 % to about 20% aggregate, from about 30 % to about 40% sand and Portland cement with or without additional constituents Pouring concrete into a third mold connected to a lateral side of the concrete wall section (30); the third mold making interconnection members (120f, 120s) for one or more concrete wall sections (30), wherein the pourable concrete comprises from about 20% to about 30 water, from about 0 % to about 20% aggregate, from about 30 % to about 40% sand and Portland cement with or without additional constituents

↓

244
Positioning an insulator-connector (60) between the outward surface (54) and the opposed surface (44) and extending the insulator-connector (60) in superior and inferior distances beyond the vertical lengths of the outward surface (54) and the opposed surface (44), thereby creating four receivers (90s, 90i, 96s, 96i) for chinking

↓

246
Connecting distinct meshes (80s, 80i, 84s, 84i) to a portion of the insulator-connector (60) extending beyond the outward surface (54) and the opposed surface (44)

↓

248
Creating a bond between the insulator-connector (60) and the outward surface (54) and the opposed surface (44), thereby stabilizing the concrete wall section (30) for transport

↓

250
Subsequent to curing, interlocking a cured first interconnection member (120f) with a cured second interconnection member (120s) to create a corner for an interlocked first concrete wall section (30) and a second concrete wall section (30); the first interconnection member (120f) interlocking with the second interconnection member (120s) at a right angle

CONCRETE WALL SECTION

BACKGROUND OF THE INVENTION

1. Field of the Invention

Among other things, the present invention is a concrete wall section. Embodiments of the concrete wall section can also include one or more interconnection members. Concrete wall sections can replace traditional framing methods of framing a structure.

2. Description of the Previous Art

Any discussion of references cited in this Description of the Previous Art merely summarizes the disclosures of the cited references and Applicant makes no admission that any cited reference or portion thereof is relevant prior art. Applicant reserves the right to challenge the accuracy, relevancy and veracity of the cited references.

References that may indicate a state-of-the-art include: 1) U.S. Pat. No. 9,157,233—Gosain discloses a system for forming an insulated concrete thermal mass wall; 2) U.S. Pat. No. 5,119,606—Graham discloses an insulated concrete wall panel; 3) U.S. Pat. No. 7,444,786—Morgenstern discloses a cast log structure; 4) US Published Patent Application 20040187411—Clegg disclose a concrete construction log; 5) U.S. Pat. No. 7,913,469—Qu, et al. discloses a concrete load-bearing wall with compound heat-insulating layer; 6) U.S. Pat. No. 551,973—Keith, et al. discloses highly insulative connector rods and methods for their manufacture and use in highly insulated composite walls; 7) U.S. patent Ser. No. 10/309,105—Foderberg disclose a system for insulated concrete composite wall panels; 8) US Published Patent Application 20120058299—Serwin discloses a composite sandwich panel; and 9) U.S. Pat. No. 8,387,338—Smith discloses a method of making concrete façade logs and siding for a building.

SUMMARY OF THE INVENTION

Among other things, the current invention provides allows a user to stack vertically two or more concrete wall sections.

An aspect of the current concrete wall section, to provide a wall section that includes an insulator-connector.

Still another aspect of the current concrete wall section is to provide a wall section that allows the user to allow the user to preselect different or identical visible wall textures on opposites of the wall section.

It is another aspect of the current concrete wall section to provide a concrete wall section with a weight from about 81 to about 162 pounds.

Yet another aspect of the current concrete wall section is to provide a concrete wall section with a R-value of from about 3.85 per inch to about 4.20 per inch.

Still another aspect of the current concrete wall section is to provide a low maintenance concrete wall section.

It is still another aspect of the current concrete wall section is to provide a product that is usable in construction of commercial, farming and residential structures.

Yet another aspect of the current concrete wall section is to provide a construction product that does not require contemporary wall studs.

Still another aspect of the current concrete wall section is to provide a construction product with an exterior appearance of wood or stone instead of concrete.

It is still another aspect of the current concrete wall section to provide a product that replaces wood timbers for structures previously constructed with wood timbers.

Yet another aspect of the current concrete wall section is to replace or minimize the use of wood.

Still another aspect of the current concrete wall section is to provide landscaping or retaining walls.

It is still another aspect of the current concrete wall section to provide an alternative to the use of wood, traditional concrete blocks or stone in structures.

A preferred embodiment of the present invention can be described as a vertical wall of a structure adapted for above-ground use, subterranean use and/or both uses, wherein segments of the vertical wall comprise a plurality of interconnected sections; each interconnected section comprising: a) an outward concrete slab of a first predetermined width; the outward concrete slab comprising an outer face and an opposed surface separated by the first predetermined width; b) an inward concrete slab of a second predetermined width; the inward concrete slab comprising an inward face and outward surface separated by the second predetermined width, wherein the opposed surface and the outward surface include corresponding dimensions; and c) an insulator-connector of a predetermined width connected to the opposed surface of the outward concrete slab and the outer surface of the inward concrete slab, wherein: i) during the concrete curing process, portions of the uncured opposed surface and the uncured outer surface penetrate into the insulator-connector creating a bond between the insulator-connector and the outward concrete slab and the inward concrete slab stabilizing the vertical section for transport; ii) the insulator-connector extends vertically for predetermined superior and inferior distances beyond the vertical lengths of the outward concrete slab and the inward concrete slab; and iii) meshes connected to a portion of the insulator-connector extending beyond the outward concrete slab and the inward concrete slab; the meshes adapted to assist with holding chinking applied subsequent to formation of the interconnected vertical section.

Another preferred embodiment of the present invention can be described as a concrete wall section of a vertical wall of a structure; the concrete wall section comprising: a) an outward concrete slab of a first width; the outward concrete slab comprising an outer face and an opposed surface separated by the first width; b) an inward concrete slab of a second width; the inward concrete slab comprising an inward face and outward surface separated by the second width; and c) an insulator-connector positioned between the outward surface and the opposed surface, wherein concrete bonds formed between the outward surface and the insulator-connector and the opposed surface and the insulator-connector form a stabilized concrete wall section for transport; the insulator-connector extending vertically for predetermined superior and inferior distances beyond the vertical lengths of the outward surface and the opposed surface.

Yet another preferred embodiment of the present invention can be described as a concrete wall section of a vertical wall of a structure; the concrete wall section comprising: a) an outward concrete slab of a first width; the outward concrete slab comprising an outer face and an opposed surface; b) an inward concrete slab of a second width; the inward concrete slab comprising an inward face and outward surface; c) an insulator-connector positioned between the outward surface and the opposed surface; the insulator-connector extending vertically for predetermined superior and inferior distances beyond the vertical lengths of the outward surface and the opposed surface; and d) a bond between the insulator-connector and the outward surface and the opposed surface, thereby stabilizing the concrete wall section for transport.

It is the novel and unique interaction of these simple elements which creates the system, methods and apparatus, within the ambit of the present invention. Pursuant to Title 35 of the United States Code, descriptions of preferred embodiments follow. However, it is to be understood that the best mode or preferred descriptions do not limit the scope of the present invention.

BRIEF DESCRIPTION OF THE DRAWINGS

FIG. 1 is a lateral perspective of concrete wall section (30).

FIG. 2 is a cross-section of FIG. 1 along plane C-C.

FIGS. 7-10 portray methods of manufacturing concrete wall sections (30).

DESCRIPTION OF THE PREFERRED EMBODIMENTS

Figure 3:
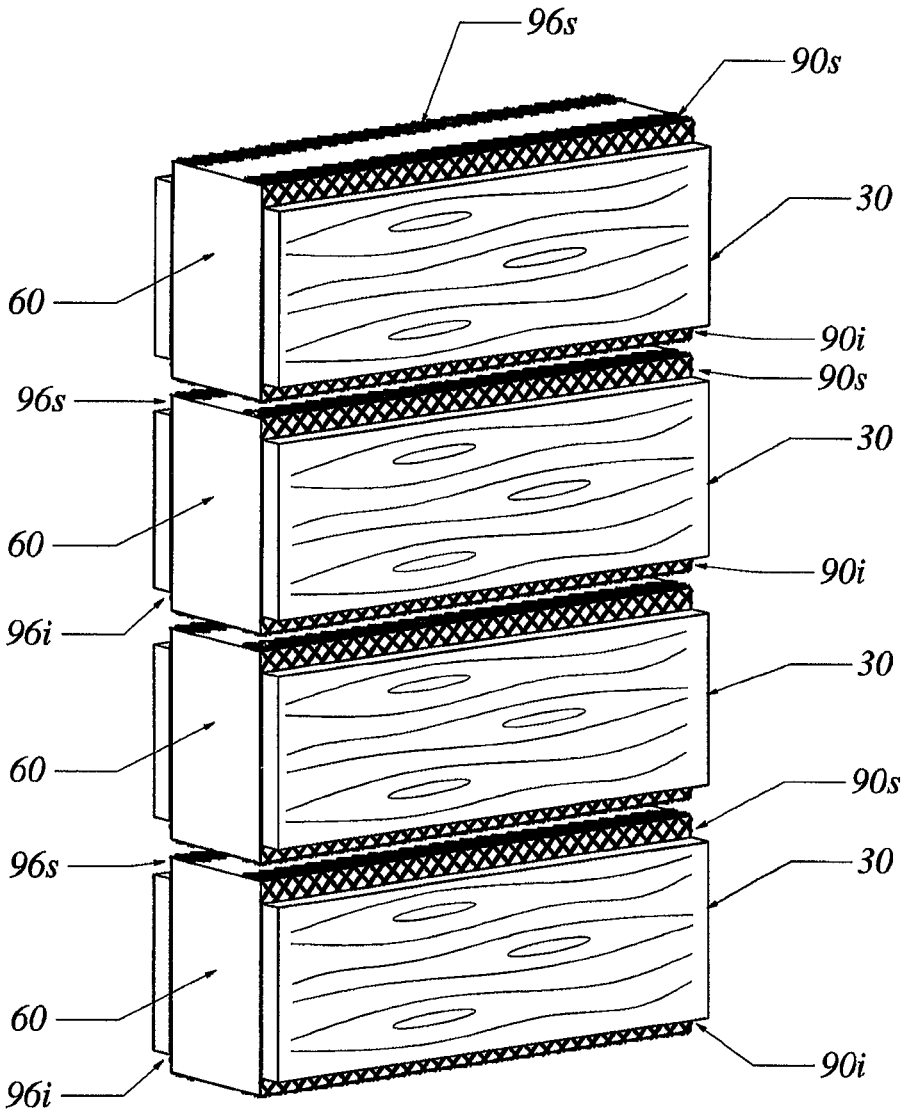
FIG. 3 is a lateral perspective of a representative segment of concrete wall (100) showing four vertically stacked concrete wall sections (30), where chinking is yet to be applied to receivers (90*s*, 90*i*, 96*s*, 96*i*) between the stacked concrete wall sections.

The disclosure hereof is detailed to enable those skilled in the art to practice the invention, and the embodiments published herein merely exemplify the present system, methods and devices and do not limit the scope of the claims appended hereto.

The present invention is directed toward the provision of a concrete wall section (30). Meeting a long felt but unfulfilled need, the current concrete wall section (30) is an insulated concrete wall section (30) with a weight and dimension that allows the user to manually transport the concrete wall section to the construction site and about the worksite without the need of using lifts or other transportation devices. Preferred embodiments of the current invention, provide concrete wall sections (30) including interconnection members (120*f*, 120*s*) creating corners and concrete wall sections (30) without interconnection members (120*f*, 120*s*). Among other things, concrete wall sections (30) provide an insulated, low maintenance and durable walls for a structure.

FIG. 1 is a lateral perspective of concrete wall section (30) and FIG. 2 is a cross section of FIG. 1 along plane C-C. Among other things, concrete wall section (30) includes outward concrete slab (40), inward concrete slab (50), insulator-connector (60) and one or more meshes (80*s*, 80*i*, 84*s*, 84*i*).

Concrete slabs (40) and (50) are formed with predetermined widths, lengths, heights and weights. Widths can range from about 8 inches to about 12 inches. Lengths can range from about 60 inches to about 120 inches. Heights can range from about 10 inches to about 19 inches. Weights can range from about 81 pounds to about 162 pounds. In accordance with the current invention, the concrete wall section (30) is of such dimensions and weight that a human can move a single concrete wall section (30) without the assistance of lifts or other transportation devices. Within the scope of the present invention, concrete wall sections (30) can have a weight of from about 81 pounds to about 162 pounds.

It has been discovered that pourable concrete used to manufacture concrete slabs (40) and (50) can have compositions of from about 20% to about 30% water, from about 0% to about 20% aggregate and from about 30% to about 40% sand with the remaining percentages of the compositions being Portland cement with or without additional constituents. For the purposes of this application, "pourable concrete" is defined as compositions of concrete that are pourable into molds to form the concrete mixture into solidified concrete slabs (40) and (50).

Outward concrete slab (40) includes outer face (42) and opposed surface (44) separated by a predetermined width. According to engineering parameters, outer face (42) can be designed to have a preselected cured visual appearance from smooth to rugged.

Inward concrete slab (50) includes inward face (52) and outward surface (54) separated by a predetermined width. According to engineering parameters, inward face (42) can be designed to have a preselected cured visual appearance from smooth to rugged.

Insulator-connector (60) is interconnected with opposed surface (44) of outward concrete slab (40) and outward surface (54) of inward concrete slab (50). Insulator-connector (60) extends vertically for predetermined superior and inferior distances beyond the vertical lengths of outward concrete slab (40) and inward concrete slab (50) creating receivers (90*s*, 90*i*, 96*s*, 96*i*).

During the concrete curing process, portions of the uncured opposed surface (44) and the uncured outward surface (54) penetrate into the insulator-connector (60) creating a bond between the insulator-connector (60) and the outward concrete slab (40) and the inward concrete slab (50). Among other things, the bond between the dried concrete and insulator-connector (60) stabilizes vertical section (30) for transport.

It has been discovered that insulator-connector (60) can be a polystyrene polymer; in particular, a closed cell expanded polystyrene foam. Among other things, insulator-connector (60) has the dual function of connecting outward concrete slab (40) and inward concrete slab (50) to form concrete wall section (30), as well as providing insulation with R-values of from about 3.85 per inch to about 4.20 per inch. Within the scope of the present invention, density of the insulator portion of the insulator-connector (60) can range from about 1.0 pound/$ft^3$ to about 1.2 pounds/$ft^3$.

Meshes (80*s*, 80*i*, 84*s*, 84*i*) are connected to portions of insulator-connector (60) extending beyond outward concrete slab (40) and inward concrete slab (50). In select preferred embodiments of the current invention, meshes (80*s*, 80*i*, 84*s*, 84*i*) are wire meshes. When engineering parameters require, one or more meshes (80*s*, 80*i*, 84*s*, 84*i*) contact a vertical and horizontal side of insulator-connector (60).

FIG. 3 is a lateral perspective of a representative segment of concrete wall (100) showing four vertically stacked concrete wall sections (30), where chinking is yet to be applied to receivers (90*s*, 90*i*, 96*s*, 96*i*) between the stacked concrete wall sections.

Figure 4:
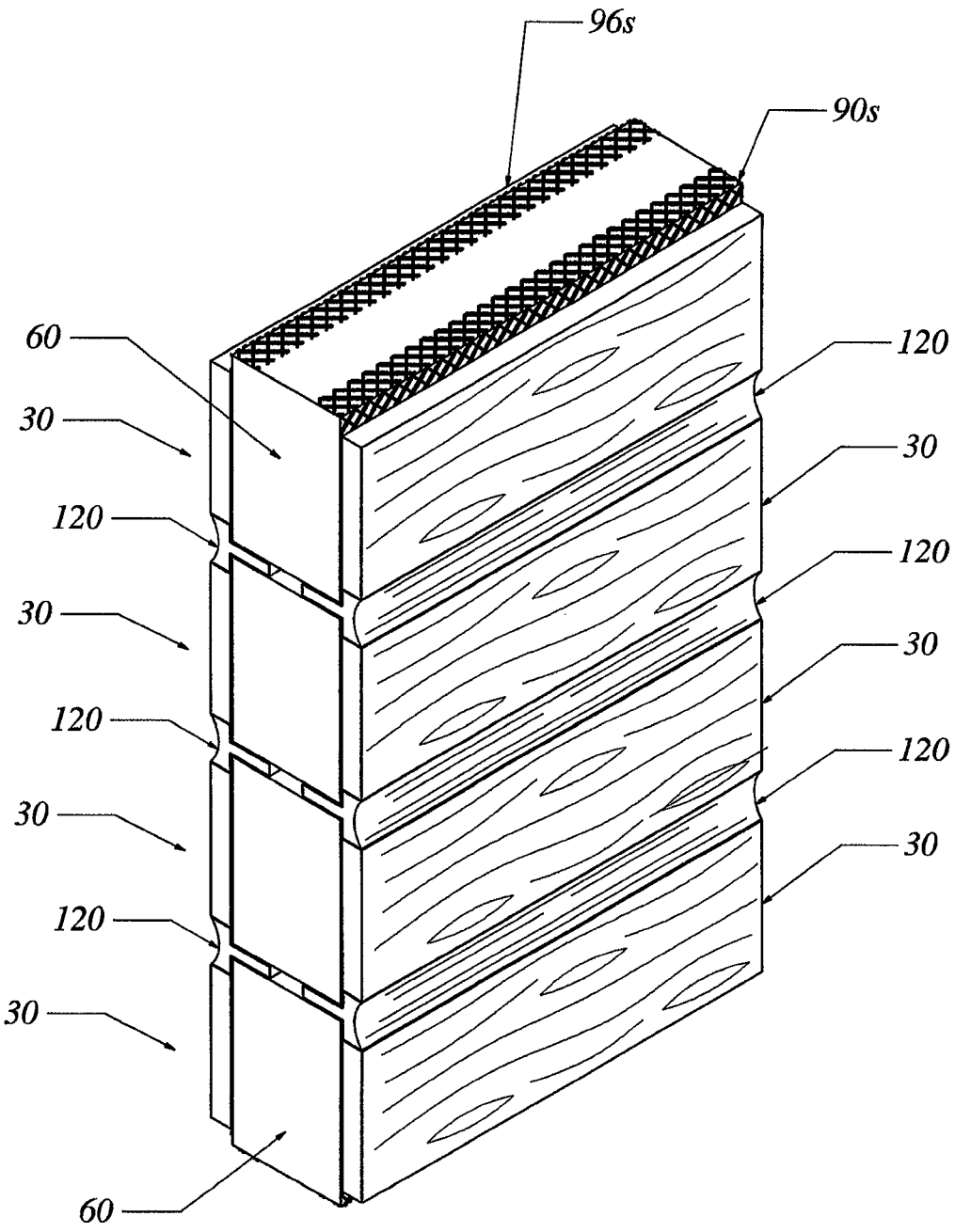
FIG. 4 is a perspective of a representative segment of concrete wall (100) showing four vertically stacked concrete wall sections (30), where chinking was applied to receivers (90*s*, 90*i*, 96*s*, 96*i*) between the stacked concrete wall sections.

FIG. 4 is a perspective of a representative segment of concrete wall (100) showing four vertically stacked concrete wall sections (30), where chinking (180) was applied to receivers (90*s*, 90*i*, 96*s*, 96*i*) between the stacked concrete wall sections.

Among other things, except for flooring and roof framing and their respective components, it has been discovered that use of vertical sections (30) to create walls can eliminate the use of conventional framing including the requirements of insulation, exterior wall studs, etc. incorporated into a conventional frame of a structure. Meshes (80*s*, 80*i*, 84*s*, 84*i*) are adapted to assist with holding chinking (180) applied subsequent to formation of the interconnected concrete wall sections (30).

Figure 5:
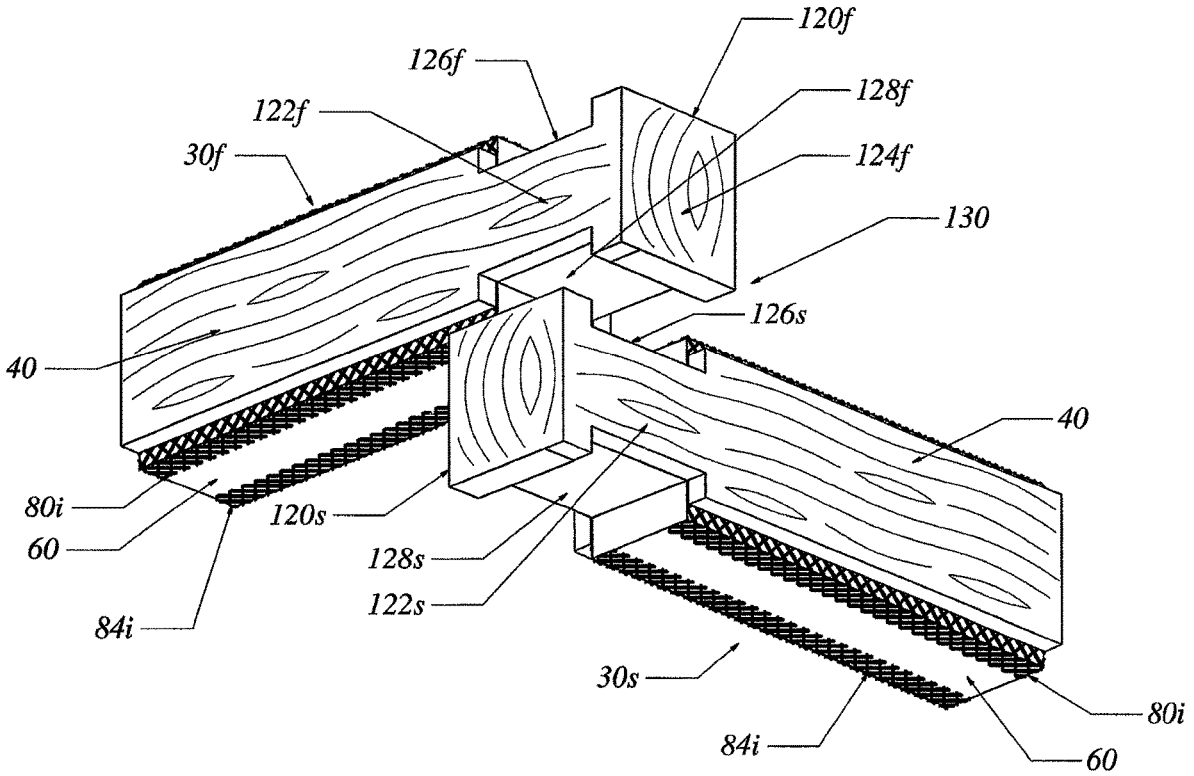
FIG. 5 is a perspective of first and second concrete wall sections (30) provided with reciprocating interconnection members (120*f*, 120*s*).
Figure 6:
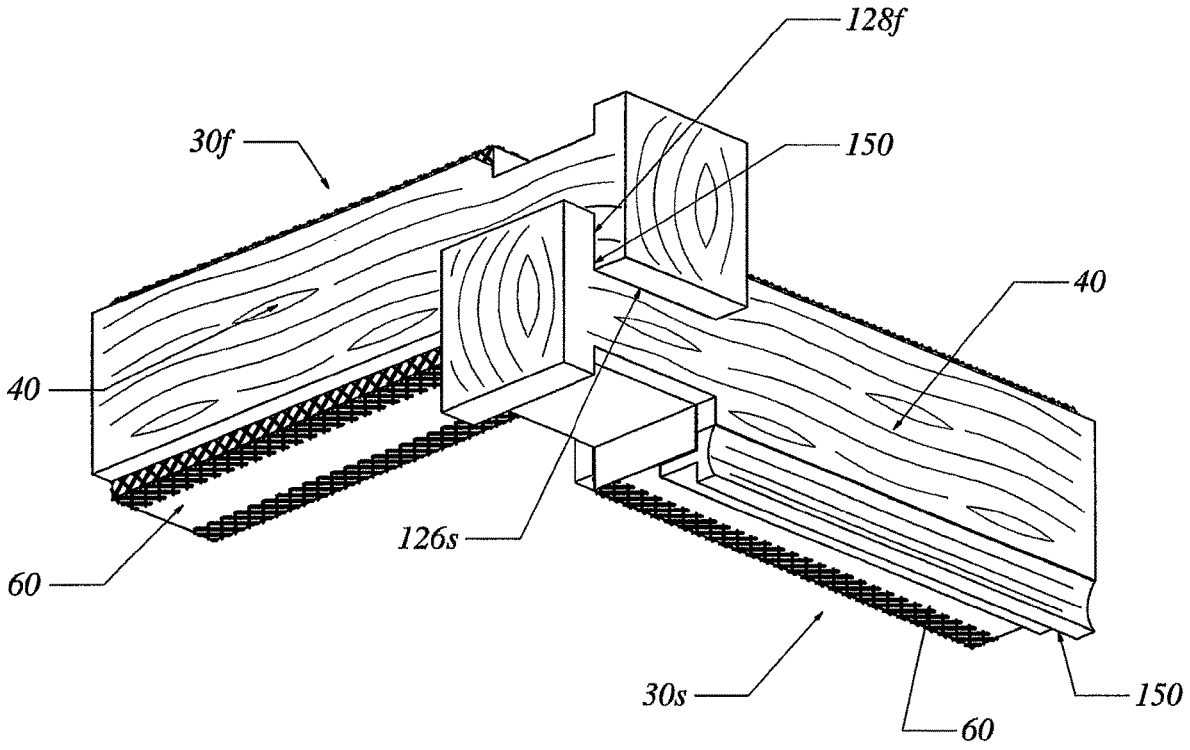
FIG. 6 is perspective of first and second concrete wall sections (30*f*, 30*s*) that have formed corner (150).
Figure 7:
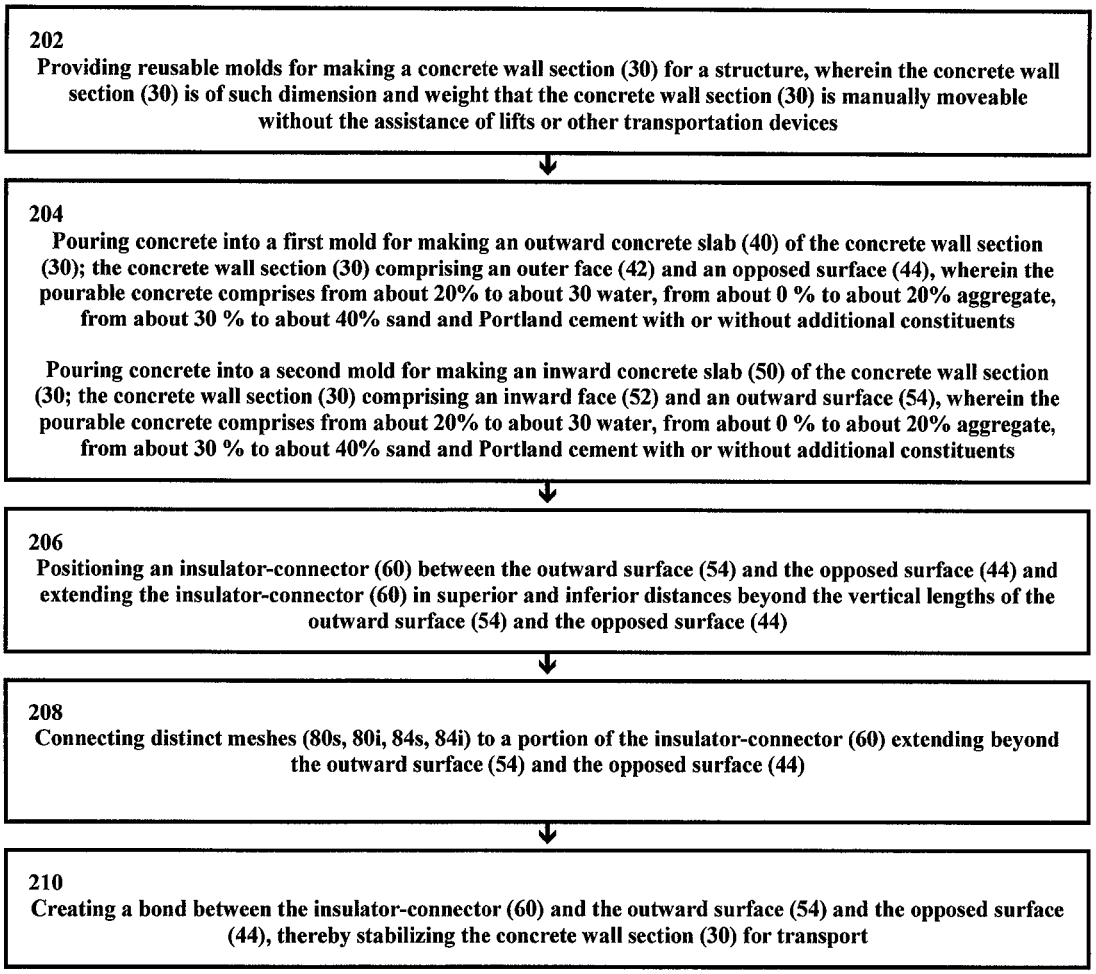
Figure 8:
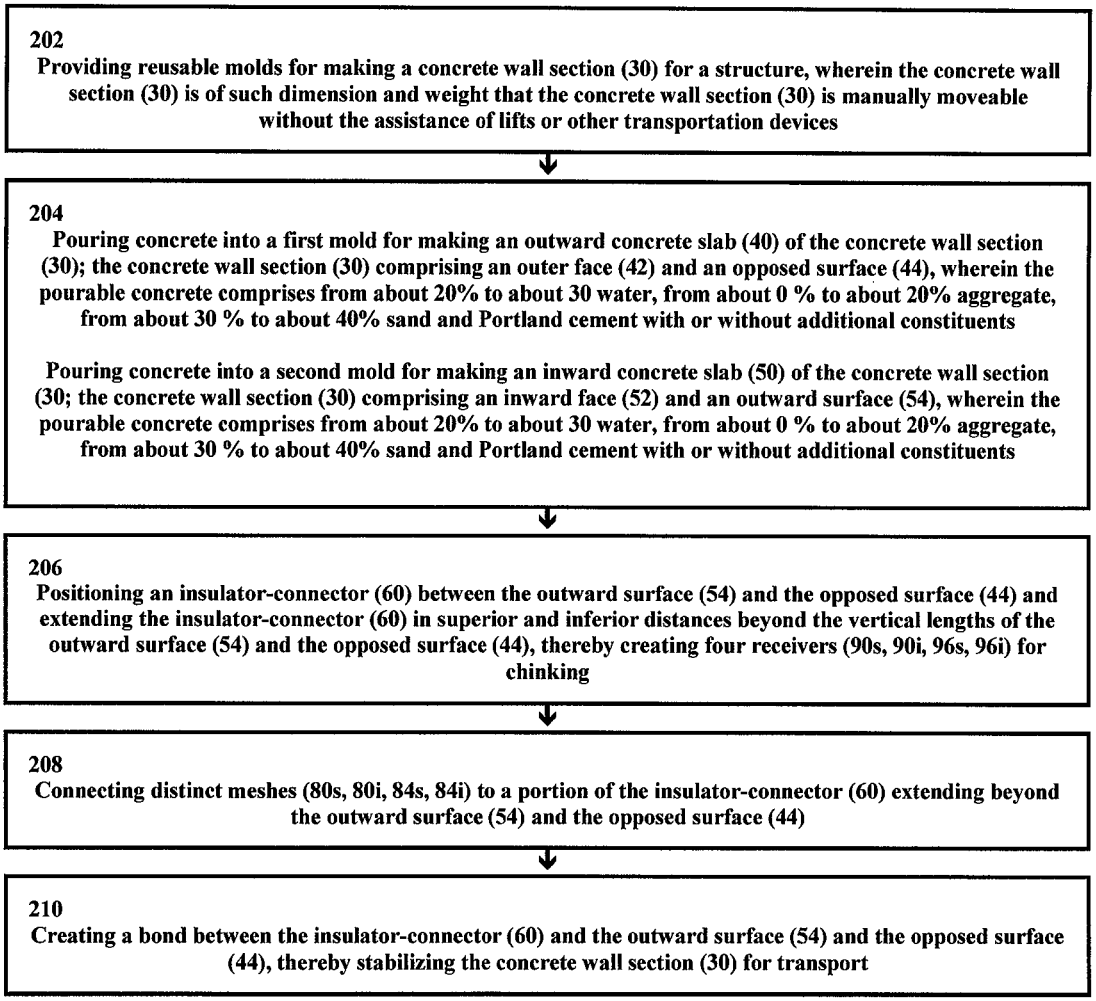

FIG. 5 is a perspective of first and second sections (30*f*, 30*s*) provided with reciprocating interconnection members (120*f*, 120*s*). As shown in FIG. 6, when interlocked, reciprocating interconnection members (120*f*, 120*s*) create a corner (150). In select preferred embodiments, interconnection members (120*f*, 120*s*) interlock at a right angle.

Interconnection member (120*f*) includes extender (122*f*), outer side (124*f*), upper gap (126*f*) and lower gap (128*f*). Interconnection member (120*s*) includes extender (122*s*), outer side (124*s*), upper gap (126*s*) and lower gap (128*s*).

FIG. 6 is perspective of first and second sections (30*f*, 30*s*) that have formed corner (150). Lower gap (128*f*) of first section (30*f*) interlocks with upper gap (126*s*) of second section (30*s*) creating corner (150). When the structure requires, sections (30) including interconnection members (120) are utilized to create corner (150).

Select steps associated with methods of manufacturing concrete wall sections (30) are depicted in FIGS. 7-10.

Steps 202-210 disclose a first method of manufacturing concrete wall sections (30).

Steps 240-250 disclose a second method of manufacturing concrete wall sections (30).

Having disclosed the invention as required by Title 35 of the United States Code, Applicants now pray respectfully that Letters Patent be granted for their invention in accordance with the scope of the claims appended hereto.

What is claimed is:

1. A vertical wall of a structure adapted for at least one of above-ground or subterranean use, wherein segments of the vertical wall comprise a plurality of interconnected sections; each interconnected section comprising:

a) an outward concrete slab of a first predetermined width; the outward concrete slab comprising an outer face and an opposed surface separated by the first predetermined width;

b) an inward concrete slab of a second predetermined width; the inward concrete slab comprising an inward face and outward surface separated by the second predetermined width, wherein the opposed surface and the outward surface include corresponding dimensions; and c) an insulator-connector of a predetermined width sandwiched between the opposed surface of the outward concrete slab and the outward surface of the inward concrete slab, wherein:

i) portions of the opposed surface and the outward surface connect directly to outward sides of the insulator-connector and penetrate into the insulator-connector creating a bond between the insulator-connector and the outward concrete slab and the inward concrete slab stabilizing the interconnected section for transport;

ii) the insulator-connector extends vertically for predetermined superior and inferior distances beyond vertical measurements of the outward concrete slab and the inward concrete slab, wherein a top and a bottom of the insulator-connector comprise parallel continuous, uninterrupted edges and a combination of the outward concrete slab, the inward concrete slab and the insulator-connector share a common longitudinal axis traversing a length of the interconnected section; and iii) meshes, positioned outward of and distinct from the insulator-connector, connected about corners of the insulator-connector; the corners extending vertically beyond the outward concrete slab and the inward concrete slab; each mesh comprising an angle configured for fitting about one of the corners; and the meshes configured to assist with holding chinking applied subsequent to positioning of the interconnected section.

2. The vertical wall of claim 1, wherein the meshes contact a vertical and a horizontal side of the insulator-connector.

3. The vertical wall of claim 2, wherein pourable concrete used to form each concrete slab comprises from about 20% to about 30% water, from about 0% to about 20% aggregate, from about 30% to about 40% sand and Portland cement.

4. The vertical wall of claim 3, wherein density of insulator portion of insulator-connector is from about 1.0 pound/$ft^3$ to about 1.2 pounds/$ft^3$.

5. The vertical wall of claim 4 further comprising an interconnection member sharing the common longitudinal axis and extending from a lateral side of more than one of the interconnected sections; the interconnection member adapted to interlock at right angles with gaps of one or more adjacent interconnection members, thereby forming a corner of the structure.

* * * * *